United States Patent [19]

Blaskowski

[11] 4,410,336

[45] Oct. 18, 1983

[54] PRODUCTION OF PIPELINE GAS FROM COAL

[75] Inventor: Henry J. Blaskowski, Avon, Conn.

[73] Assignee: Combustion Engineering, Inc., Windsor, Conn.

[21] Appl. No.: 351,838

[22] Filed: Feb. 24, 1982

[51] Int. Cl.[3] ..... C10J 3/00

[52] U.S. Cl. ..... 48/210; 48/197 R; 48/206; 60/39.182; 518/703

[58] Field of Search ..... 48/197 R, 191, 206, 48/210; 60/39.18 B; 518/703

[56] References Cited

U.S. PATENT DOCUMENTS

| | | | |
|---|---|---|---|
| 2,423,527 | 7/1947 | Steinschlaeger | 518/703 X |
| 3,031,287 | 4/1962 | Benson et al. | 518/703 X |
| 4,092,825 | 6/1978 | Egan | 518/703 X |
| 4,121,912 | 10/1978 | Barber et al. | 48/197 R |
| 4,202,167 | 5/1980 | Suggitt et al. | 48/197 R X |

OTHER PUBLICATIONS

Information Series 64 "Coal Gassification a State of the Art Review" Berkowitz 4/1973, p. 21, FIG. 4-1.

Clean Fuels from Coal Symposium II 11T Res. Inst Auditorium Inst. of Gas Technology 1975, pp. 14 and 102.

*Primary Examiner*—Robert L. Lindsay, Jr.

*Attorney, Agent, or Firm*—William W. Habelt

[57] ABSTRACT

A process for producing pressurized pipeline gas wherein coal is gasified in oxygen at a relatively low pressure, typically less than 5 atmospheres, to produce a raw gas containing carbon monoxide, hydrogen, carbon dioxide, gaseous sulfur compounds and particulates. A major portion of the raw gas is cooled, cleaned and methanated to produce a pipeline quality product gas consisting essentially of methane. The remaining portion of the raw gas is cleaned, compressed and combusted to produce a high temperature, high pressure flue gas which is used to power a gas turbine and generate steam to power a steam turbine. The gas turbine and steam turbine each drive compressors for compressing the low pressure product gas to pipeline pressure.

4 Claims, 1 Drawing Figure

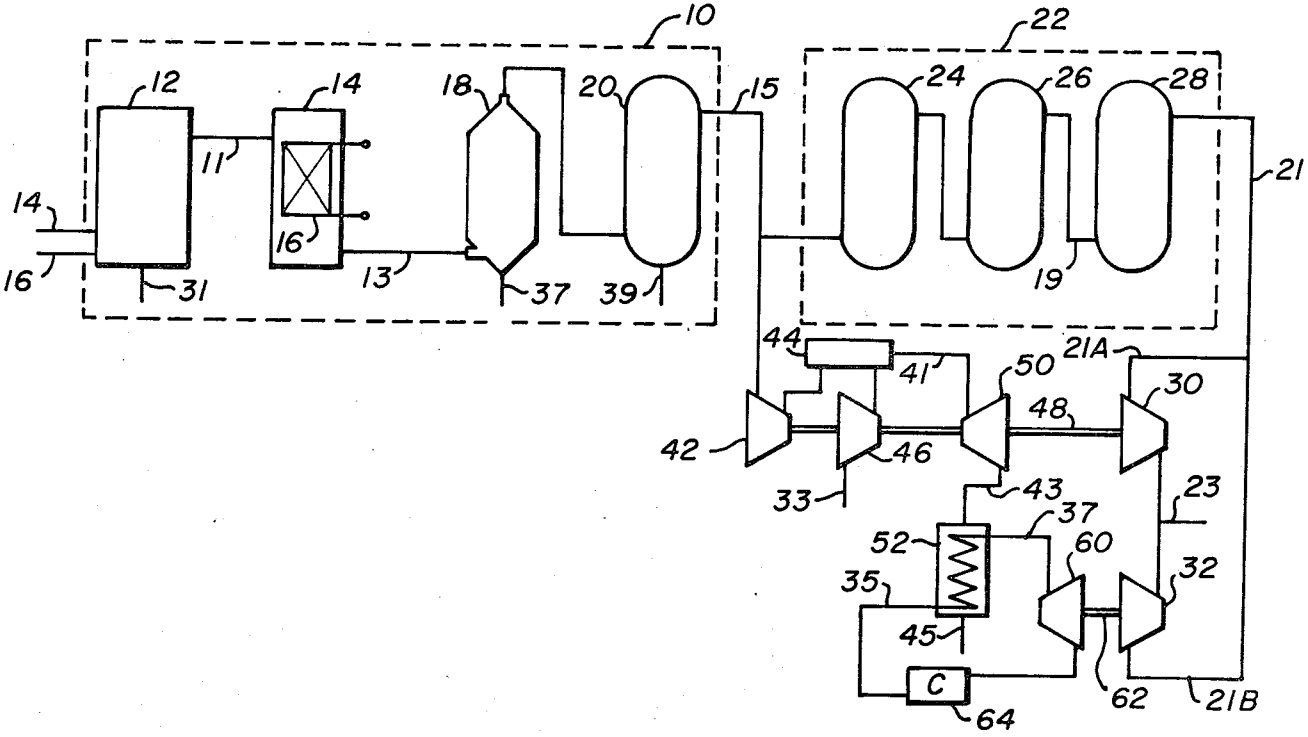
21
21B
28
26
24
22
19
21A
30
23
32
62
60
37
48
50
43
64
C
41
46
52
45
35
44
33
42
15
10
20
39
37
18
13
14
16
11
12
31
14
16

PRODUCTION OF PIPELINE GAS FROM COAL

BACKGROUND OF THE INVENTION

The present invention relates to the production of a pipeline gas from a hydrocarbonaceous fuel, and more particularly, to a process for producing a pipeline gas from a product gas produced via the low pressure gasification of coal.

The prior art processes for producing a synthetic pipeline gas from coal are many and varied. U.S. Pat. Nos. 3,854,859, 3,922,148 and 4,208,191 exemplify the typical prior art manufacture of synthetic pipeline gas from coal. In such processes, the coal is typically gasified under relatively high pressure with oxygen or oxygen and steam to produce a pressurized product gas containing carbon monoxide, hydrogen, carbon dioxide, gaseous sulfur compounds, and particulates. The gasification step is usually carried out at a relatively high pressure of from 20 to 100 atmospheres and a temperature in the range of about 650 C. to 1200 C.

The hot product gas is then cooled to a temperature in the range of about 100 to 250 C., and purified to remove substantially all of the gaseous sulfur compounds and particulate contained therein. The cooled, purified product gas is then passed through a gas enrichment step wherein the hydrogen and carbon monoxide in the product gas are converted to methane and the carbon dioxide removed to produce a high-pressure, synthetic gas consisting essentially of methane and having a heating value of about 33.5 megajoules per cubic meter to about 41 megajoules per cubic meter. In the gas enrichment process, it is often necessary to pass the cooled, purified product gas to a shift reactor prior to methanation to adjust the hydrogen to carbon monoxide ratio in the product gas to a value in the range of about 0.8 to 1 to about 2.5 to 1.

Since these processes depend on relatively high pressures, typically in the range of 20 to 100 atmospheres, the gasifier and all the downstream gas processing equipment, such as the gas cooler, the gas purifiers and the gas enrichment reactors, must be large, thick-walled pressure vessels. Additionally, the connections and cross connections between the various reactor vessels and the gasifier or gasifiers must also be thick-walled pressure containment conduits. Additionally, seals must be provided at each connection point which can withstand the high pressures. These and other complications attendant with high pressure systems significantly increase complexity of the production of synthetic pipeline gas from coal.

SUMMARY OF THE INVENTION

It is an object of the present invention to provide a process for the synthetic production of high-pressure pipeline gas from coal via the gasification of the coal at a relatively low pressure.

In accordance with the present invention, coal is gasified in oxygen at a relatively low pressure, typically less than 5 atmospheres, to produce a raw gas containing carbon monoxide, hydrogen, carbon dioxide, gaseous sulfur compounds and particulates. The raw gas produced in the gasification step is cooled to a temperature in the range of about 200 C. to about 400 C., and purified to remove substantially all of the sulfur compounds and particulates contained therein. The clean raw gas is then enriched by converting the carbon monoxide and hydrogen contained therein to yield a gas containing methane and carbon dioxide. This gas is then further enriched by removing the carbon dioxide therefrom to yield a pipeline quality gas consisting essentially of methane. The methane enriched gas is then pressurized to pipeline pressure to yield a high-pressure synthetic pipeline gas.

In accordance with the present invention, a portion of the clean raw gas from the gas cleaning plant bypasses the gas enrichment process and is instead combusted with compressed air to provide a high temperature, high pressure flue gas. This high temperature, high pressure flue gas is then expanded through a gas turbine to drive a first gas compressor. The flue gas exhausted from the gas turbine is passed in heat exchange relationship with a pressurized vaporizable liquid, preferably water, to produce a pressurized vapor, such as steam. The pressurized vapor is expanded through a vapor turbine to drive a second gas compressor. The enriched gas from the gas enrichment step is passed through the first and second compressors to compress the methane enriched gas to pipeline pressure and thereby providing pipeline quality synthetic natural gas.

Further, the enriched gas from the gas enrichment step may be split into two portions with one portion being passed through the first gas compressor and the other portion through the second gas compressor. Alternatively, the enriched gas from the gas enrichment step may be passed first through the first gas compressor and thence through the second gas compressor. In either case, the enriched gas from the gas enrichment step is compressed to a pressure in the range of 10 to 100 atmospheres in order to provide a synthetic natural gas of pipeline quality.

BRIEF DESCRIPTION OF THE DRAWING

The process of the present invention will be further described with respect to a preferred embodiment thereof as illustrated in the accompanying drawing wherein the single FIGURE of drawing is a simplified schematic flow diagram illustrating the present invention in the best mode now contemplated for carrying it out.

DESCRIPTION OF A PREFERRED EMBODIMENT

Referring now to the drawing, a raw synthesis gas 11 is produced by the gasification of coal at a relatively low pressure, typically less than 5 atmospheres, in a gas production plant schematically shown and generally indicated as 10. The gas production plant includes a coal gasifier 12 of a type well known in the art in order to effect gasification of the coal. Coal 14 is reacted with oxygen 16 in the gasifier 12 to produce a combustible raw gas consisting essentially of carbon monoxide, hydrogen and carbon dioxide. The gas further includes gaseous sulfur compounds, such as hydrogen sulfide and carbonyl sulfide, resulting from sulfur impurities contained in the coal. Additionally, although much of the ash in the coal is removed in the gasification process as a molten slag 31, the gas further includes particulate ash particles.

The raw synthesis gas 11 from the gasifier 12 passes through a gas cooler 14 wherein the raw synthesis 11 is passaged through heat exchanger 16 in heat exchange relationship with a cooling fluid, most commonly water, to cool the raw synthesis gas to a temperature in the range of about 200 C. to 400 C. The cooled, raw synthesis gas 13 then passes through a particulate scrubber 18 wherein the particulate ash particles are removed from the gas and through sulfur scrubber 20 wherein the gas is contacted with an absorption solution to remove the gaseous sulfur compounds therefrom. The particulate scrubber 18 may be any of a number of well-known particulate scrubbing devices, such as a spray dryer or a mechanical collector or an electrostatic precipitator, taken alone or in combination. Any of a number of well-known acid gas absorption processes may be employed in sulfur scrubber 20 to remove the hydrogen sulfide and carbonyl sulfide and any other gaseous sulfur compounds contained in the raw synthesis gas.

The gasification of coal at a relatively low pressure to produce a clean raw synthesis gas as briefly described hereinbefore in the discussion of the gas production plant 10 is well known in the art and forms no part of the present invention. In view of this fact, no further details with respect to the production of a clean raw synthesis gas via lowpressure coal gasification are deemed necessary for a complete understanding of the present invention.

The clean raw synthesis gas 15, which is substantially free of particulate and gaseous sulfur compounds, is passed to a gas enrichment plant 22 wherein the carbon monoxide and hydrogen in the raw synthesis gas are converted to methane and the carbon dioxide removed from the raw synthesis gas. Although the clean raw synthesis gas 15 entering the gas enrichment plant 22 may be passed directly to the methanator 26, it is often desirable to first pass the clean raw synthesis gas 15 to a shift reactor 24 wherein the molar ratio of hydrogen to carbon monoxide is adjusted to be in the range of about 0.8 to 1 to about 2.5 to 1 and preferably to about 2 to 1. The reactions for effecting the shift in hydrogen to carbon monoxide ratio are well known in the art and need not be discussed further. In the methanator 26 the carbon monoxide in the clean raw synthesis gas 15 is converted to methane by any number of well-known reactions typically involving catalyst. As the methanation step per se does not form part of the present invention, no further discussion of the methanation reaction will be presented.

The methane enriched synthesis gas 19 withdrawn from the methanator 26 is passed to a carbon dioxide scrubber 28 wherein the carbon dioxide in the methane enriched synthesis 19 is removed therefrom to produce a product synthesis gas 21 consisting essentially of methane and closely resembling natural gas.

The product synthesis gas 21 will be at a relatively low pressure as it is a product of the low pressure gasification of coal in the gasifier 12. All processes in the gas production plant 10 and the gas enrichment plant 22 are carried on a relatively low pressure. It may be necessary at various locations in the process to boost the pressure of the synthesis gas to a few atmospheres as it leaves one or more of the reactors in order to compensate for pressure losses experienced by the gas in traversing the reactors or the conduit interconnecting the various reactors. However, it is important to note that at all points in the gas production and the gas enrichment process, the synthesis gas is maintained at a relatively low pressure, typically less than five (5) atmospheres.

In order to boost the methane enriched product synthesis gas 21 to pipeline pressure, the product synthesis gas 21 is passed through compressors 30 and 32 to raise the pressure of the product gas to pipeline pressure and thereby produce a pipeline quality synthesis natural gas 23. In accordance with the present invention, the energy necessary to drive compressors 30 and 32 to compress the product gas 21 to pipeline pressure is supplied by combusting a portion of the clean raw synthesis gas 15 leaving the gas production plant 10.

According to the present invention, a portion of the clean raw synthesis gas 15 leaving the gas production plant 10 bypasses the gas enrichment plant 22 and is compressed in a gas compressor 42 and supplied under pressure to combustor 44. The pressurized clean raw gas is combusted in air to produce a high temperature, high pressure flue gas 41. The air 33 supplied to the combustor 44 is first passed through a compressor 46 and pressurized to a level compatible with that of the pressurized raw synthesis gas.

The high temperature, high pressure flue gas 41 exhausting from the combustor 44 is passed to and expanded through a gas turbine 50. The gas turbine 50 drives through shaft 48, the synthesis gas compressor 42, the air compressor 46 and the first product gas compressor 30. The flue gas exhausted from the gas turbine 50 is then passed through a heat exchanger 52, such as a waste heat boiler, and heat exchange relationship with a pressurized vaporizable liquid 35, such as water, produce a pressurized vapor 37, such as steam. The flue gas 45 leaving the heat exchanger 52 is vented to the atmosphere. The pressurized vapor 37 is passed through a vapor turbine 60 which drives through shaft 62, the second product gas compressor 32. The vapor 39 exhausting from the vapor turbine 60 is passed to a condensor 64 and condensed to a liquid 35 which is compressed and returned to the heat exchanger 52.

The methane enriched product synthesis gas 21 may be split into a first portion 21A which is passed through the first product gas compressor 30 and boosted to pipeline pressure thereby and into a second portion 21B which is passed through the second product gas compressor 32 and thereby pressurized to pipeline pressure. Alternatively, the methane enriched product synthesis gas 21 may be first passed through the gas turbine driven first product gas compressor 30 and thence therefrom through the vapor turbine driven second product gas compressor 32 and thereby pressurized to pipeline pressure.

By utilizing a portion of the clean raw synthesis gas 15 from the gas production plant 10 as a source to drive the product gas compressors 30 and 32, the methane enriched product synthesis gas 21 can be raised to pipeline pressure. Therefore, in order to produce a pipeline quality natural gas 23 from coal, it is no longer necessary to gasify the coal at pipeline pressures. Rather, the coal may be gasified at a relatively low pressure and the raw synthesis gas cooled, cleaned and enriched all at a relatively low pressure.

Though only one embodiment for carrying out the process of the present invention has been shown, it will be appreciated that modifications thereof, some of which have been eluded to herein, may readily be made thereto by those in the art. Therefore, the appended claims are intended to cover the modifications eluded to herein as well as any of the modifications which fall within the true spirit and scope of our invention as recited in the appended claims.

I claim:

1. A low pressure gasification process for producing pressurized pipeline gas from coal comprising:

a. gasifying coal in oxygen at a relatively low pressure of less than about 5 atmospheres to produce a raw gas containing carbon monoxide, hydrogen, carbon dioxide, gaseous sulfur compounds and particulates;

b. cooling the raw gas produced in the gasification step to a temperature in the range of about 200 C. to about 400 C.;

c. purifying the cooled raw gas thereby removing substantially all of the sulfur compounds and particulates contained therein;

d. converting the carbon monoxide and hydrogen in the substantially sulfur-free and particulate-free gas to methane to yield an enriched ggas containing methane and carbon dioxide;

e. removing the carbon dioxide from the methane enriched gas;

f. compressing a portion of the substantially sulfur-free and particulate-free gas produced in step (c);

g. combusting the pressurized substantially sulfur-free and particulate-free gas with compressed air to provide a high temperature, high pressure flue gas;

h. expanding the high temperature, high pressure flue gas through a gas turbine to drive a first gas compressor;

i. passing the flue gas exhausted from the gas turbine in heat exchange relationship with a pressurized vaporizable liquid to produce a pressurized vapor;

j. expanding the pressurized vapor through a vapor turbine to drive a second gas compressor; and k. passing the methane enriched gas through the first and second gas compressors to compress the methane enriched gas to pipeline pressure.

2. A process as recited in claim 1 wherein step (k) comprises passing a first portion of the methane enriched gas through the first gas compressor and a second portion of the methane enriched gas through the second gas compressor.

3. A process as recited in claim 1 wherein step (k) comprises passing the methane enriched gas first through the first gas compressor and thence through the second gas compressor.

4. A process as recited in claim 1, 2 or 3 wherein the methane enriched gas is compressed to a pressure in the range of 10 to 100 atmospheres.

* * * * *